United States Patent [19]

Vanassche et al.

[11] 3,957,518

[45] May 18, 1976

[54] DIRECT-POSITIVE SILVER HALIDE EMULSIONS

[75] Inventors: Willy Joseph Vanassche, Kontich; Herman Alberik Pattyn, Kapellen; Yvon Louis Renotte, Liege, all of Belgium

[73] Assignee: AGFA-GEVAERT N.V., Mortsel, Belgium

[22] Filed: July 9, 1973

[21] Appl. No.: 377,298

[30] Foreign Application Priority Data

July 13, 1972 United Kingdom ..... 32889/72

[52] U.S. Cl. ..... 96/64; 96/94 R; 96/107; 96/108

[51] Int. Cl.[2] ..... G03C 5/24; G03C 1/02; G03C 1/28

[58] Field of Search ..... 96/108, 64, 107, 101, 96/94 R

[56] References Cited

UNITED STATES PATENTS

| | | | |
|---|---|---|---|
| 2,717,833 | 9/1955 | Wark | 96/108 |
| 3,501,305 | 3/1970 | Illingsworth | 96/108 |
| 3,560,213 | 2/1971 | Hunt | 96/94 R |
| 3,647,455 | 3/1972 | Burt et al. | 96/94 R |
| 3,672,900 | 6/1972 | Kurz | 96/94 R |
| 3,717,466 | 2/1973 | Florens et al. | 96/108 |
| 3,772,030 | 11/1973 | Gilman et al. | 96/108 |
| 3,782,957 | 1/1974 | Ohkubo et al. | 96/108 |

*Primary Examiner*—Mary F. Kelley
*Attorney, Agent, or Firm*—A. W. Breiner

[57] ABSTRACT

Direct-positive silver halide emulsions comprising fogged silver halide grains and having adsorbed to the surface of said grains an electron-acceptor have improved stability and speed when subsequent to fogging of said grains and addition of the said electron-acceptor the pH of the emulsion is lowered, preferably below pH 6.

16 Claims, No Drawings

DIRECT-POSITIVE SILVER HALIDE EMULSIONS

The present invention relates to improved direct-positive photographic silver halide emulsions and to methods for their preparation.

It is known that direct-positive images can be obtained with certain types of photographic silver halide emulsions without previously forming a negative silver image. For example, the silver halide grains can be fogged during or after coating on a support by an overall exposure to actinic radiation or by overall chemically fogging e.g. by means of reducing agents. Upon image-wise exposure of the prefogged emulsions the development centres formed by said fogging are destroyed at the exposed areas and remain at the unexposed areas. By subsequent conventional development by means of silver halide developers a direct-positive image is formed. A particularly suitable class of direct-positive silver halide emulsions consists of direct-positive emulsions comprising electron-acceptors or desensitizers e.g. a desensitizing dye, which are adsorbed to the surface of the fogged silver halide grains.

Most of the basic steps of preparing these direct-positive silver halide emulsions may be generically the same as for common negative emulsion preparation with the difference that chemical ripening is replaced by an overall fogging treatment. The various stages may be as follows:

a. the precipitation of very small silver halide grains by mixing an aqueous solution of a water-soluble silver salt, commonly silver nitrate, with an aqueous solution of a water-soluble hhalide, commonly an ammonium halide, or alkali metal halide in the presence of a hydrophilic colloid, usually gelatin, which may be dissolved in either one or both of the above solutions or in a separate aqueous solution, b. the growth of the grains to the appropriate size, c. the removal of the by-products from the grain-formation and growth stage, called washing, d. the overall fogging of the silver halide grains, and e. the final preparation including the addition of electron-acceptor (s) and, if desired, of spectral sensitizer(s) and the addition of the conventional ingredients before coating such as coating aids, hardening agents, etc.

Direct-positive fogged silver halide emulsions of the type described generally have slow speeds and low stability upon storing. Therefore, many efforts have been made and are still being made to increase the speed and stability of these direct-positive silver halide emulsions.

It is an object of the present invention to provide novel direct-positive photographic silver halide emulsions.

Another object of the present invention is to provide novel direct-positive photographic silver halide emulsions, which have increased speed and high stability of the photographic characteristics upon storing.

A further object of the present invention is to provide a process of preparing these novel direct-positive photographic silver halide emulsions.

Still another object of the present invention is to provide photographic elements comprising a support having coated thereon such novel direct-positive photographic silver halide emulsions.

Other objects of this invention will become apparent from the disclosure herein.

The above objects are accomplished by lowering the pH of a washed, finished silver halide emulsion comprising fogged silver halide grains and having adsorbed to the surface of said grains an electron-acceptor. In accordance with the present invention direct-positive photographic silver halide emulsions comprising fogged silver halide grains and having adsorbed to the surface of said grains an electron-acceptor, which emulsions show improved speed and/or stability upon storing, are prepared by lowering the ph of the emulsion, subsequent to the fogging of the silver halide grains and the addition of the electron-acceptor, to a sufficient degree to effectively increase the stability and/or speed of the silver halide emulsion.

Fogging of the silver halide grains can occur in any suitable manner, which consists of providing the silver halide grains with silver nuclei and/or nuclei of a metal more electropositive than silver including gold, platinum, palladium, iridium, etc.

The silver halide grains may be provided with silver nuclei e.g. by an overall uniform exposure to actinic radiation and preferably by reduction sensitization, for example by high pH and/or low pAg silver halide precipitating or digestion conditions e.g. as described by Wood, J. Phot. Sci. 1 (1953) 163, or by treatment with reducing agents e.g. tin (II) salts e.g. tin(II)chloride, tin complexes and tin chelates of the (poly)amino(poly)-carboxylic acid type as described in British Pat. No. 1,209,050 filed Dec. 27, 1967 by Agfa-Gevaert N. V., formaldehyde, hydrazine, hydroxylamine, sulphur compounds such as thiourea dioxide, phosphonium salts such as tetra(hydroxymethyl)phosphonium chloride, polyamines such as diethylenetriamine, bis(p-aminoethyl)sulphide and its water-soluble salts, etc.; preferred reducing agents are thiourea dioxide and tin(II) chloride.

The silver halide grains can also be provided with nuclei of a metal more electropositive than silver, for example, by treatment of the silver halide grains (which may have been provided with silver nuclei) with a compound of a metal more electropositive than silver, preferably in the form of water-soluble salts e.g. potassium chloroaurate, gold(III) chloride, ammonium hexachloropalladate, potassium chloroiridate and the like. The treatment with a gold compound may occur by means of a mixture of a water-soluble noble metal compound e.g. gold (III) chloride and thiocyanates forming complexes with gold and having a solvent action on the silver halide grains, e.g. alkali metal and ammonium thiocyanates.

In the formation of direct-positive silver halide emulsions, fogging of the silver halide grains is very suitably effected by means of a reducing agent e.g. thiourea dioxide and a compound of a metal more electropositive than silver, especially a gold compound. The reducing agent is preferably used initially and the gold compound subsequently. However, the reverse order can be used or both compounds can be used simultaneously.

The degree of fogging of the direct-positive silver hhalide emulsions may vary within a very wide range. This degree of fogging depends, as is known in the art, on the concentration of the fogging agents used as well as on the pH, the pAg, the temperature and the duration of the fogging treatment. High photographic speeds are obtained at low degrees of fogging as is illustrated in U.S. Pat. No. 3,501,307 of Bernard D. Illingsworth issued Mar. 17, 1970 and U.S. Ser. No.

318,989 filed Dec. 27, 1972.

In U.S. Pat. No. 3,501,307 as mentioned above direct-positive silver halide emulsions comprising fogged silver halide grains and a compound accepting electrons, are described wherein the grains are fogged to such extent that a test portion of the emulsion when coated on a support to give a maximum density of at least about 1 upon processing for 6 minutes at about 20°C in a developer of the composition given hereinafter has a maximum density which is at least about 30% greater than the maximum density of an identical test portion processed for 6 minutes at about 20°C in such developer after being bleached for about 10 minutes at about 20°C in a bleach of the composition given hereinafter.

| | |
|---|---|
| Bleach | |
| potassium cyanide | 50 mg |
| glacial acetic acid | 3.47 ml |
| sodium acetate | 11.49 g |
| potassium bromide | 119 mg |
| water to make | 1 liter |
| Developer | |
| N-methyl-p-aminophenol sulphate | 2.5 g |
| sodium sulphite | 30.0 g |
| hydroquinone | 2.5 g |
| sodium metaborate | 10.0 g |
| potassium bromide | 0.5 g |
| water to make | 1 liter |

According to copending U.S. Ser. No. 318,989 as mentioned above the silver halide grains are fogged to such an extent that a test portion of the emulsion, when coated on a support at a coverage of 0.50 g to 5.50 g of silver per sq.m gives a density of less than 0.50 upon processing without exposure for 6 min. at 20°C in the above developer and an identical test portion thhereof when coated in an identical way gives a density of at least twice the value of the density of the first test portion and a density of at least 0.50 upon processing without exposure for 3 minutes at 20°C in a developer of the following composition:

| | |
|---|---|
| hydroquinone | 15 g |
| 1-phenyl-3-pyrazolidinone | 1 g |
| trisodium salt of ethylenediamine-tetraacetic acid | 1 g |
| anhydrous sodium carbonate | 30 g |
| anhydrous sodium sulphite | 70 g |
| 40 % aqueous sodium hydroxide | 16 ml |
| water to make | 1 liter (pH : 11) |

As a consequence, the terms "fogged" and "fogging" as used herein are employed in a very broad sense so that the very low degrees of fogging as defined in the above copending U.S. Ser. No. 318,989 are also embraced, which means that fogging is effected to such extent that a test portion of the emulsion when coated on a support at a coverage of 0.50 to 5.50 g of silver per sq.m., gives a density of at least 0.50 upon processing for 3 minutes at 20°C in the above latter developer composition.

The direct-positive silver halide emulsions comprising fogged silver halide grains according to the present invention are of the type containing an electron-acceptor or desensitizer, which is adsorbed to the fogged silver halide grains.

According to Sheppart et al J. Phys. Chem. 50 (1946) 210, Stanienda, Z. Phys. Chem. (NF) 32 (1962) 238, and Dähne, Wiss. Phot. (1969) 161, desensitizers are dyestuffs whose cathodic polarographic half-wave potential, measured against the calomel electrode, is more positive than −1.0 V. Suchlike compounds have also been described in U.S. Pat. Specifications No. 3,501,305 – 3,501,306 and 3,501,307 all of Bernard D. Illingsworth issued Mar. 17, 1970. The sensitizers described in German Patent Specification No. 1,153,246 filed Apr. 11, 1962 by Agfa A.G. and U.S. Patent Specification 3,314,796 of Johannes Götze, August Randolph and Oskar Riester issued Apr. 18, 1967 are also suitable for this purpose as well as imidazo-quinoxaline dyestuffs, e.g. those described in Belgian Patent Specification No. 660,253 filed Feb. 25, 1965 by Kodak Co.

It is known to characterize these electron-accepting or desensitizing compounds by means of their polarographic half-wave potential. Electron acceptors suitable for use in the direct-positive silver halide emulsions of the present invention have an anodic polarographic half-wave potential and a cathodic polarographic half-wave potential that when added together give a positive sum. Methods of determining these polarographic half-wave potentials have been described, e.g., in U.S. Pat. Nos. 3,501,310 of Bernard D. Illingsworth issued Mar. 17, 1970 and 3,531,290 of Roberta A. Litzerman issued Sept. 29, 1970.

The electron-accepting compounds preferably have spectrally sensitizing properties although it is possible to use electron-accepting compounds that do not spectrally sensitize the emulsion.

In the formation of the direct-positive silver halide emulsions according to the present invention, the pH is lowered, after fogging of the silver halide grains, which is preferably effected at neutral or higher pH values e.g. at least about pH 6.5, and addition of an electron-acceptor, preferably just before coating i.e. after the addition of the coating finals. The speed and stability tends to increase as acidity is increased. The pH of the emulsion is preferably lowered to at least below pH 6 and the acidity may be increased to values well below 6 until such strength of acid is obtained as results in undesirable reduction of the maximum density of silver deposited on development. The pH value is preferably lowered to about 5.

In addition to lowering the pH before coating of the direct-positive silver halide emulsion to a degree to effectively increase the speed and stability, it was found advantageous to increase the pAg of the emulsion ready for coating. By increasing the pAg it was found possible to further increase the speed and stability of the emulsion.

Though fogging of direct-positive silver halide emulsions can occur at a large variety of pAg values by simply adapting the fogging conditions, e.g. the pH and temperature conditions during fogging, the amounts of reducing agents and/or of noble metal compound used for fogging and the duration of the fogging treatment, it is preferred in accordance with the present invention to effect fogging at a pAg-value corresponding to an E.M.F. of at least +60 mV, preferably higher (Ag/-saturated reference calomel electrode) i.e. at a pAg of at most 8.2, preferably lower.

When fogging is effected at these pAg values and the pAg of the direct-positive silver halide emulsion comprising fogged silver halide grains having adsorbed to the surface thereof an electron-acceptor is increased subsequent to the fogging operation and the addition of the electron-acceptor, e.g. to a value corresponding to an E.M.F. below +60 mV i.e. at a pAg below 8.2 before coating, it was found that in addition to a gain in speed and stability by lowering the pH, the speed and stability could be further increased.

Increasing the pAg can be suitably effected by addition of a water-soluble compound forming water-insoluble silver salts or silver complexes. For this purpose water-soluble bromides and/or water-soluble iodides have been found particularly suitable, e.g. bromide and iodide salts of ammonium, potassium, sodium, lithium, cadmium and strontium. Other compounds yielding bromide or iodide ions in aqueous medium are also suitable for the purpose The silver halides of the direct-positive silver halide emulsions of the present invention may be silver chloride, silver bromide, silver chlorobromide, silver chloroiodide, silver bromoiodide, and silver chlorobromoiodide.

Especially suitable for use in accordance with the present invention are direct-positive silver halide emulsions the silver halide grains of which have an average grain diameter of less than about 1 micron, preferably less than 0.5 micron. The silver halide grains may be regular and may have any of the known shapes e.g. cubic, octahedral or even rhombohedral. They may have a substantially uniform diameter frequency distribution e.g. 95% by weight of the silver halide grains can have a diameter which is within about 40%, preferably within about 30% of the mean grain diameter.

In the preparation of the direct-positive photographic silver halide emulsion for use in accordance with the present invention gelatin is preferably used as vehicle for the silver halide grains. However, the gelatin may be wholly or partly replaced by other natural hydrophilic colloids, for example, albumin, zein, agar-agar, gum arabic, alginic acid, and salts thereof, etc. or synthetic hydrophilic resins, for exemple polyvinyl alcohol, polyvinyl pyrrolidone, acrylamide polymers, cellulose ethers, partially hydrolyzed cellulose acetate and the like.

The direct-positive silver halide emulsions for use in accordance with the present invention may comprise all kinds of emulsion ingredients suitable for direct-positive emulsions. They may comprise for example, speed-increasing compounds, e.g. polyalkylene glycols, cationic surface-active agents of the ammonium, sulphonium and phosphonium type, thioethers, etc. They may further comprise known antifoggants and stabilizers, which include thiazolium salts, azaindenes, e.g. hydroxytetraazaindenes such as 5-methyl-7-hydroxy-s-triazolo[1,5-a]pyrimidine, mercury compounds e.g. mercury oxide, mercury chloride, mercury cyanide, nitro-indazoles, nitrobenzimidazoles, mercaptotetrazoles such as 1-phenyl-5-mercaptotetrazole, etc. They may comprise as compounds increasing the reversal speed of direct-positive silver halide emulsions selenium compounds of the kind described in Belgian Patent No. 763,827 filed Mar. 5, 1971 by Gevaert-Agfa N.V., quinone compounds of the kind described in U.S. Defensive Publication No. T883,031 of Paul B. Gilman, Jr., and Frederik J. Rauner issued Feb. 23, 1971, polymeric as well as non-polymeric 1,2- and 1,4-dihydroxybenzene compounds e.g. 2-chlorohydroquinone, tetrachlorohydroquinone, pyrocatechol, the polymeric reaction product of quinone with ammoniac prepared as described in Wysokomoljekoejarnyje Soedinenija, 1968, Part A(X), Nr. 8, p.1890 by Berlin et al in which the hydroquinone or quinone recurring units are interlinked by —NH— units, and other related polymeric compounds having interlinking —S— and —O— units, as well as polymeric compounds comprising hydroquinone substituents, e.g. those described in U.S. Pat. Nos. 3,165,495 of Lloyd D. Taylor issued Jan. 21, 1965 and 3,186,970 of Norman W. Schuler issued June 1, 1965. Spectrally sensitizing dyes that are not electron-accepting may also be present in the emulsion, for example, cyanines, merocyanines, complex (trinuclear) cyanines, complex (trinuclear) merocyanines, styryls and hemicyanines.

Further, colour couplers may be incorporated in the direct-positive emulsions employed in the present invention. Particularly suitable are colour couplers showing a low halogen-accepting character which can be determined by the test described by R. P. Held in Phot. Sci. Eng. Vol. 11, (1967) p. 406. For this purpose a dispersion of silver bromide grains in buffered 0.1 N potassium bromide is illuminated and the potential is registered by means of a calomel/platinum electrode system. During illumination the platinum electrode potential rises rapidly to the redox potential of bromine. On addition of a colour coupler the potential rise can be delayed through "halogen acceptance" by the colour coupler. Colour couplers as well as other emulsion ingredients including binding agents for the silver halide that do not delay or do not substantially delay the potential rise are particularly suitable for use in direct-positive silver halide emulsions.

The colour couplers can be incorporated into the direct-positive photographic silver halide emulsion using any suitable technique known to those skilled in the art for incorporating colour couplers in silver halide emulsions. For example, water-soluble colour couplers e.g. those containing one or more sulpho or carboxyl groups (in acid or salt form) can be incorporated from an aqueous solution, if necessary, in the presence of alkali and the water-insoluble or insufficiently water-soluble colour couplers from a solution in the appropriate water-miscible or water-immiscible high-boiling (oil-former) or low-boiling organic solvents or mixtures of solvents, which solution is dispersed, if necessary in the presence of a surface-active agent, in a hydrophilic colloid composition forming or forming part of the binding agent of the silver halide emulsion; if necessary the low-boiling solvent is removed afterwards by evaporation.

The silver halide emulsion layer and other hydrophilic colloid layers of a direct-positive photographic material employed in accordance with the present invention may be hardened by means of organic or inorganic hardeners commonly employed in photographic silver halide elements, for example, the aldehydes and blocked aldehydes such as formaldehyde, dialdehydes, hydroxyaldehydes, mucochloric and mucobromic acid, acrolein, glyoxal, sulphonyl halides and vinyl sulphones, etc.

The direct-positive photographic silver halide elements may further contain antistatic agents, wetting agents as coating aids, e.g. saponin and synthetic surface-active compounds, plasticizers, matting agents, e.g. starch, silica, polymethyl methacrylate, zinc oxide, titanium dioxide, etc., optical brightening agents including stilbene, triazine, oxazole and coumarin brightening agents, light-absorbing materials and filter dyes, mordanting agents for anionic compounds, etc.

The direct-positive silver halide emulsions can be coated on one or both sides of a wide variety of supports, which include opaque supports e.g. paper and metal supports as well as transparent supports e.g. glass, cellulose nitrate film, cellulose ester film, polyvinyl acetal film, polystyrene film, polyethylene terephthalate film, polycarbonate film and other films of resinous materials. It is also possible to employ paper coated with α-olefin polymers e.g. paper coated with polyethylene, polypropylene, ethylene-butene copolymers etc.

Development of the exposed direct-positive silver halide emulsions of the invention may occur in alkaline solutions containing conventional developing agents such as hydroquinones, catechols, aminophenols, 3-pyrazolidinones, phenylenediamines, ascorbic acid and derivatives, hydroxylamines, etc. or combinations of developing agents. The exposed direct-positive emulsions may be developed to produce direct-positive black-and-white images or they may be developed to produce direct-positive colour images by means of aromatic primary amino colour developing agents, more particularly the known p-phenylenediamine developing agents, in the presence of colour couplers, which are incorporated in the emulsion or in the developing composition.

Development may occur by means of a combination of developing agents that have a superadditive action, e.g. hydroquinone together with N-methyl-p-aminophenol sulphate or other p-aminophenol derivatives and hydroquinone or a p-phenylenediamine colour developing agent together with 1-phenyl-3-pyrazolidinone or other 3-pyrazolidinone derivatives.

It is very advantageous to employ energetic developers, especially when the silver halide grains of the direct-positive silver halide emulsion have been fogged to a very low degree, e.g. to the extent described in Illingsworth's U.S. Pat. No. 3,501,307 issued Mar. 17, 1970 or even to a lower extent as described in the co-pending U.S. Ser. No. 318,989 as mentioned above.

The high-energy may be obtained by properly alkalizing the developing composition (pH 9–12), by using relatively high concentrations of ingredients in the developer, by using high-energy developing agents or a combination of developing agents, which when used together are known to produce a superadditive effect, for example hydroquinone/1-phenyl-3-pyrazolidinone and hydroquinone/N-methyl-p-aminophenol sulphate, by addition to the developer of development accelerators, e.g. polyethylene glycol and other polyoxyalkylene compounds as well as quaternary ammonium or phosphonium compounds and ternary sulphonium compounds. For example, favourable results are obtained by means of developing compositions comprising per liter at least 5 g of hydroquinone and an auxiliary superadditive developing agent, e.g. 1-phenyl-3-pyrazolidinone and N-methyl-p-aminophenol sulphate the optimum concentration of which relative to the amount of hydroquinone can be determined by routine laboratory experiments.

As is described in co-pending U.S. Ser. No. 318,988 filed Dec. 27, 1972 it may be advantageous to effect development of the exposed direct-positive silver halide emulsions with compositions substantially free from halide ions. Development with developing compositions substantially free from halide ions is particularly favourable in order to obtain high maximum densities for direct-positive silver halide emulsions the silver halide grains of which have been fogged to a very low degree, e.g. as described in Illingsworth's U.S. Pat. No. 3,501,307 and co-pending U.S. Ser. No. 318,989 as mentioned above.

One or more developing agents may be incorporated in the direct-positive photographic element. They may be incorporated in the silver halide emulsion itself and/or in another suitable location in the photographic element. Development can then be effected by means of an alkaline processing solution called development activator solution, which is substantially free of developing agents.

Where development is effected with compositions substantially free from halide ions, the processing solution used to effect development of the exposed direct-positive silver halide emulsion and which comprises or does not comprise one or more developing agents is preferably supplied in an amount that suffices for the treatment of exactly one piece of light-sensitive element. As a matter of fact, when the processing solution is used repeatedly for processing successive silver bromide-containing elements the processing solution inevitably becomes contaminated with alkaline bromide. Therefore it is preferred to use a single-use bath. A bath of this type offers the advantage that ageing and contamination of the bath composition are eliminated. For one-time use the processing solution is preferably relatively viscous so as to be easily controlled when spread. Viscous processing solutions can be obtained by addition of a thickening agent, for example a water-soluble polymer. The film-forming plastic may be any of the high molecular weight polymers that are stable to alkali and that are soluble in aqueous alkaline solutions e.g. hydroxyethylcellulose, starch or gum, polyvinyl alcohol, the sodium salts of polymethacrylic acid and polyacrylic acid, sodium alginate, sodium carboxymethyl cellulose etc. The relatively viscous processing composition may be confined within a container, which is ruptured at the moment of development as is done, for example, in the well-known silver complex diffusion transfer process for in-camera processing.

The following examples illustrate the present invention.

EXAMPLE 1

A mono-disperse, cubic, direct-positive photographic silver bromide emulsion, having an average grain size of 0.1 micron, was prepared under controlled pH, pAg and temperature conditions during the precipitation of the silver halide. The pH was maintained at 4, the pAg at 8.2 and the temperature at 40°C. The emulsion was chill-set, shredded and washed with cold water. At 40°C, gelatin and water were added in order to obtain a gelatin to silver nitrate ratio of 1.4 and a concentration of silver halide corresponding to 50 g of silver nitrate pro kg of emulsion. The emulsion was digested at 60°C, pH 7 and pAg 5.16 for 4 h 45 min in the presence of potassium chloroaurate (15 mg/mole of silver nitrate).

After addition of 600 mg of pinacryptol yellow and 600 mg of the following spectral sensitizer:

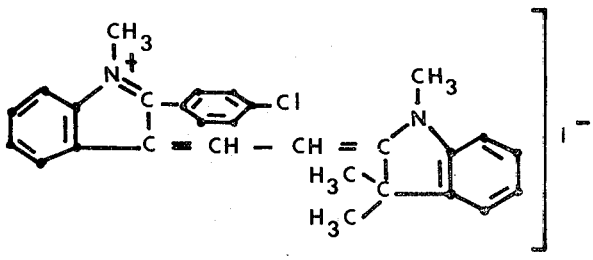

per mole of silver halide, the emulsion was divided into several aliquot portions. The various emulsion portions were coated on a conventional support at coverages of 3.75 g of silver per sq.m, after the pH and pAg of the emulsions had been adjusted by addition of sulphuric acid and potassium bromide to the values listed in the following table.

The emulsions were dried, exposed in a sensitometer and developed at 20°C for 3 min in a developer of the following composition:

| | |
|---|---|
| water | 800 ml |
| p-monomethylaminophenol sulphate | 1.5 g |
| sodium sulphite (anhydrous) | 50 g |
| hydroquinone | 6 g |
| sodium carbonate (anhydrous) | 32 g |
| potassium bromide | 2 g |
| water to make | 1000 ml |

After development, the emulsions were fixed, washed and dried in the usual way. The results attained are listed in the following table. The values given for the speed are relative values, a value of 100 was given to the emulsion coated at pH 7 and pAg 7.68. The speed was measured at a density value 0.2 below maximum density.

Table

| Emulsion | pH | pAg(EMF) | $D_{min}$ | $D_{max}$ | relative speed |
|---|---|---|---|---|---|
| 1 | 7 | 7.68(+100 mV) | 0.10 | 4.08 | 100 |
| 2 | 7 | 8.53(+50 mV) | 0.10 | 4.10 | 138 |
| 3 | 7 | 9.35(0 mV) | 0.10 | 4.00 | 159 |
| 4 | 7 | 10.18(−50 mV) | 0.08 | 4.00 | 240 |
| 5 | 7 | 11.02(−100 mV) | 0.12 | 4.00 | 339 |
| 1a | 6 | 7.68 | 0.10 | 4.00 | 120 |
| 2a | 6 | 8.52 | 0.10 | 4.10 | 145 |
| 3a | 6 | 9.35 | 0.10 | 4.08 | 191 |
| 4a | 6 | 10.18 | 0.08 | 3.96 | 276 |
| 5a | 6 | 11.02 | 0.12 | 3.94 | 324 |
| 1b | 5 | 7.68 | 0.10 | 3.98 | 145 |
| 2b | 5 | 8.52 | 0.10 | 4.08 | 178 |
| 3b | 5 | 9.35 | 0.10 | 3.96 | 251 |
| 4b | 5 | 10.18 | 0.10 | 4.04 | 339 |
| 5b | 5 | 11.02 | 0.09 | 4.02 | 479 |
| 1c | 4 | 7.68 | 0.10 | 4.20 | 191 |
| 2c | 4 | 8.52 | 0.12 | 4.00 | 240 |
| 3c | 4 | 9.35 | 0.11 | 4.10 | 381 |
| 4c | 4 | 10.18 | 0.09 | 3.98 | 576 |
| 5c | 4 | 11.02 | 0.08 | 3.86 | 692 |

The above results show that by lowering the pH (at same pAg value) the speed is increased and that by simultaneously increasing the pAg the speed can be further increased.

It was further found that for a same pAg value the lower the pH the higher the stability was and that optimum stability was reached at lowest pH and highest pAg value.

EXAMPLE 2

A monodisperse cubic direct-positive photographic silver bromide emulsion, having an average grain size of about 0.3 μm was prepared by adding 3 molar aqueous solutions of silver nitrate and potassium bromide with a double jet device to a 9% aqueous gelatin solution under controlled pH, pAg and temperature conditions. The pH was maintained at 5.8 (pH of the gelatin solution), the pAg at 8.2 and the temperature at 60°C. On regular intervals, a volume part of the emulsion equal to the volume added in the previous interval was removed. The silver bromide deposition continued on the remaining crystals so that they grew more rapidly.

Finally, the silver content of the prepared emulsion was determined and an equivalent of 5% of potassium iodide was added. After 30 minutes digestion at 60°C, the emulsion was chill-set, shredded and washed with cold water. At 40°C, gelatin and water were added in order to obtain a ratio of gelatin to silver halide expressed as silver nitrate of 1.4. The emulsion comprised per kg an amount of silver halide corresponding to 50 g of silver nitrate.

The emulsion was then digested at pAg 5.16 and pH 7.0 for 25 minutes at 57°C in the presence of 1.5 mg of potassium chloroaurate per mole of silver halide. After addition of 400 mg of pinakryptol yellow and 400 mg of the spectral sensitizer of example 1 per mole of silver halide, the emulsion was divided in different portions. The pAg- and pH-values of each portion were adjusted as listed in the table hereinafter whereupon the portions were coated on a conventional support at coverages of 3.75 g of silver per sq.m. The emulsions were dried, exposed in a sensitometer, and developed at 20°C for 3 minutes in a developer of the following composition:

| | |
|---|---|
| hydroquinone | 15 g |
| 1-phenyl-3-pyrazolidinone | 1 g |
| trisodium salt of ethylene diamine tetraacetic acid | 1 g |
| anhydrous sodium carbonate | 30 g |
| anhydrous sodium sulphite | 70 g |
| 40% aqueous sodium hydroxide | 16 ml |
| water to make | 1 liter (pH : 11). |

After development the emulsions were fixed, washed and dried in the usual way. The results obtained are listed in the following table:

| pAg | pH | relative speed | $D_{min}$ | $D_{max}$ |
|---|---|---|---|---|
| 7.68 | 7 | 100 | 0.30 | 3.30 |
| 8.52 | 7 | 132 | 0.20 | 3.20 |
| 8.52 | 6 | 144 | 0.18 | 3.46 |
| 9.35 | 7 | 166 | 0.18 | 3.22 |
| 9.35 | 5 | 209 | 0.14 | 3.20 |
| 10.18 | 7 | 182 | 0.18 | 3.30 |
| 10.18 | 5 | 263 | 0.14 | 3.32 |

EXAMPLE 3

An emulsion was prepared as described in example 1 and divided into several aliquot portions. After adjustment of the pH and pAg to the values listed in the table below, the emulsion portions were coated on a conventional support at coverages of 2.85 g of silver per sq.m. and dried.

Strips of the direct-positive elements were exposed in a sensitometer, developed at 20°C for 3 min. in the developer of example 1, fixed, washed and dried in the usual way. Other strips were exposed and processed analogously after having been stored for 3 days at 35°C and 80 percent of relative humidity.

The sensitometric results are listed in the following table. The stability of the speed can be learned from the value of ΔS.

Table

| Emulsion | pH | pAg | Fresh material $D_{min}$ | Fresh material $D_{max}$ | Fresh material rel. speed | Stored material $D_{min}$ | Stored material $D_{max}$ | Stored material rel. speed | ΔS |
|---|---|---|---|---|---|---|---|---|---|
| 1 | 7 | 7.35 | 0.44 | 1.60 | 100 | 0.11 | 1.38 | 151 | 51 |
| 2 | 7 | 8.35 | 0.32 | 1.65 | 124 | 0.08 | 1.60 | 163 | 39 |
| 3 | 7 | 9.35 | 0.12 | 1.95 | 157 | 0.06 | 1.92 | 179 | 22 |
| 4 | 7 | 10.35 | 0.08 | 2.14 | 180 | 0.06 | 2.00 | 190 | 19 |
| 5 | 9 | 8.35 | 0.20 | 1.74 | 121 | 0.08 | 1.48 | 155 | 34 |
| 6 | 7 | 8.35 | 0.20 | 1.91 | 127 | 0.08 | 1.50 | 161 | 34 |
| 7 | 5 | 8.35 | 0.12 | 2.00 | 150 | 0.08 | 1.88 | 169 | 19 |

The above values show that the stability increases with increased pAg and lower pH.

EXAMPLE 4

A mono-disperse, cubic, direct-positive photographic emulsion containing approximately 80 mole % silver chloride, 18 mole % silver bromide and 2 mole % silver iodide, and having an average grain size of 0.25 micron, was prepared under controlled pH, pAg and temperature conditions during the precipitation of the mixed silver halide. The pH was maintained at 5, the pAg at 6.83 and the temperature at 60°C. The emulsion was chill-set, shredded and washed with cold water. At 40°C, gelatin and water were added in order to obtain a gelatin to silver nitrate ratio of 0.6 and a concentration of silver halide corresponding to 160 g of silver nitrate pro kg of emulsion. The emulsion was digested at 57°C, pH 7 and pAg 6.16 for about 2 h in the presence of potassium chloroaurate (1.5 mg/mole of silver nitrate).

After addition of 500 mg of pinacryptol yellow and 340 mg of the following spectral sensitizer:

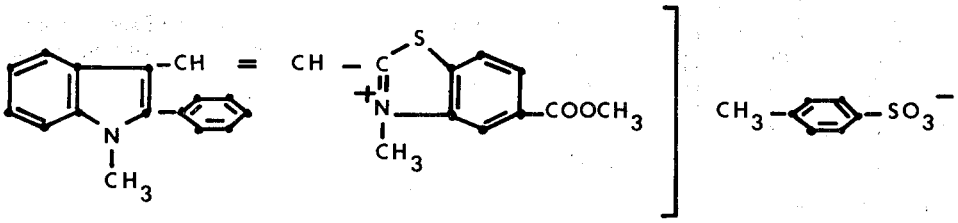

per mole of silver halide, the emulsion was divided into five portions. Before coating, the pH and pAg values of the different portions were adjusted to the values listed in the following table by addition of potassium bromide and sulphuric acid.

The values for the speed obtained after development for 3 min at 20°C in a hydroquinone-formaldehyde bisulphite "lith"-developer, fixing, washing and drying are listed in the following table. The values given are relative values for the speed measured at density $$\frac{D_{max} - D_{min}}{2}.$$

| Emulsion portion | pH | pAg | Relative speed |
|---|---|---|---|
| I | 6 | 8.35 | 100 |
| II | 5.75 | 8.35 | 126 |
| III | 5.50 | 8.35 | 170 |
| IV | 5.20 | 8.35 | 282 |
| V | 5.20 | 9.60 | 955 |

We claim:

1. A method for the preparation of direct-positive silver halide emulsions comprising providing a silver halide emulsion having fogged silver halide grains and having an electron-accepting compound adsorbed onto the surface of said grains wherein said electron-accepting compound has an anodic polarographic half-wave potential and a cathodic polarographic half-wave potential which when added together give a positive sum; and the fogging of said grains having occurred at a pH value of 6.5 or higher, and at a pAg value of 8.2 or lower, and subsequent to said fogging of said grains and the addition of the electron-acceptor, lowering the pH of said emulsion to a value below 6.5 and increasing the pAg to a value above 8.2.

2. Method according to claim 1, wherein the pH is lowered to a value of at least below 6.

3. Method according to claim 1, wherein the pH is lowered to about 5.

4. Method according to claim 1, wherein fogging of the silver halide grains occurs by reduction sensitization.

5. Method according to claim 1, wherein the silver halide grains are fogged by reduction sensitization and treatment with a compound of a metal more electropositive than silver.

6. Method according to claim 5, wherein reduction sensitization occurs by treatment of the silver halide grains with a reducing agent.

7. Method according to claim 6, wherein said reducing agent is thiourea dioxide or tin (II) chloride.

8. Method according to claim 5, wherein the reduction sensitization occurs by low pAg or high pH or low pAg and high pH silver halide precipitating or digestion conditions.

9. Method according to claim 1, wherein the silver halide grains have an average grain diameter of less than 1 micron.

10. Method according to claim 1, wherein a spectral sensitizer is added to the emulsion together with the electron-acceptor.

11. Method according to claim 2 wherein the pAg is increased to a value of at least 8.85.

12. A method for the preparation of direct-positive silver halide emulsions comprising the steps of forming silver halide grains; growing said formed silver halide grains, washing to remove by-products from said grain formation and grain growth, fogging of the silver halide grains, adding an electron-acceptor to said fogged grains, wherein said electron-acceptor has an anodic polarographic half-wave potential and a cathodic polarographic half-wave potential which when added together give a positive sum and said fogging occurring at an emulsion pH above 6.5 and a pAg below 8.2, and subsequent to said fog formation and adding of an electron-acceptor lowering the pH of the emulsion to a value below 6.5 and increasing the pAg to a value above 8.2.

13. A photographic element comprising a support and at least one direct-positive silver halide emulsion layer containing fogged silver halide grains and adsorbed to the surface of said grains an electron-acceptor having an anodic polarographic halfwave potential and a cathodic polarographic halfwave potential which, when added together, give a positive sum, said emulsion layer being formed by fogging said grains of said silver halide emulsion at a pH value of 6.5 or higher and at a pAg value of 8.2 or lower, adsorbing said electron-acceptor to said grains, lowering the pH of said emulsion to a value below 6.5 and increasing the pAg to a value above 8.2 and thereafter coating said support with said emulsion to form a silver halide emulsion layer on said support.

14. A photographic element according to claim 13 wherein the pH value of said emulsion is lowered to about 5.

15. A photographic element according to claim 14 wherein the pAg value of said emulsion is increased to 8.85 or higher.

16. A photographic element according to claim 14 wherein a spectral sensitizer is added to said emulsion prior to coating.

* * * * *